US006189720B1

(12) United States Patent
Gillispie

(10) Patent No.: US 6,189,720 B1
(45) Date of Patent: Feb. 20, 2001

(54) MODULAR INDUSTRIAL DRUM STORAGE SYSTEM

(75) Inventor: John G. Gillispie, Glen Dale, WV (US)

(73) Assignee: Eagle Manufacturing Company, Wellsburg, WV (US)

( * ) Notice: Under 35 U.S.C. 154(b), the term of this patent shall be extended for 0 days.

(21) Appl. No.: 09/435,410

(22) Filed: Nov. 8, 1999

(51) Int. Cl.[7] ..... A47G 23/02
(52) U.S. Cl. ..... 220/571; 222/108; 141/311 A
(58) Field of Search ..... 220/571, 567.2; 222/108; 141/311 A

(56) References Cited

U.S. PATENT DOCUMENTS

| | | | | |
|---|---|---|---|---|
| 3,353,615 | * | 11/1967 | Nekimken | 220/571 X |
| 3,391,730 | | 7/1968 | Calhoun, Jr. | 165/47 |
| 4,796,540 | | 1/1989 | Pelfrey | 108/55.3 |
| 5,170,721 | | 12/1992 | Troth et al. | 108/51.1 |
| 5,285,989 | | 2/1994 | Zilbert et al. | 248/146 |
| 5,307,931 | | 5/1994 | Gillispie et al. | 206/386 |
| 5,316,174 | * | 5/1994 | Schutz | 220/571 |
| 5,375,537 | | 12/1994 | Gillispie et al. | 108/51.1 |
| 5,392,911 | | 2/1995 | Gillispie et al. | 206/386 |
| 5,480,191 | | 1/1996 | Litin et al. | 280/831 |
| 5,527,052 | | 6/1996 | Litin | 280/47.26 |
| 5,562,047 | | 10/1996 | Forney et al. | 108/51.1 |
| 5,636,753 | | 6/1997 | Wilkinson et al. | 211/59.4 |
| 5,642,834 | | 7/1997 | Shaw et al. | 220/720 |

OTHER PUBLICATIONS

Dixie Poly–Drum Corporation—Catalog.
Ultratech International, Inc.—Catalog.

* cited by examiner

*Primary Examiner*—Steven Pollard
(74) *Attorney, Agent, or Firm*—Armstrong, Westerman, Hattori, McLeland & Naughton

(57) ABSTRACT

A system for storing industrial drums in a manner allowing convenient dispensing of stored material contents from any of the drums during storage. The system comprises modular components which can be combined in a multitude of configurations to comply with drum storage requirements. When used in combination with means for retaining hazardous-material leaked from the drums or spilled during dispensing, contamination of the environment and/or injury to workplace personnel is prevented. The components of the invention direct the leaked or spilled material to the hazardous-material retaining means. Storage of "hazardous material" as well as other materials is accomplished in a safe and convenient manner.

28 Claims, 10 Drawing Sheets

MODULAR INDUSTRIAL DRUM STORAGE SYSTEM

FIELD OF THE INVENTION

The present invention relates to a system using modular components for use in storing industrial drums. The drums are disposed to enable dispensing of drum contents during storage and components of the system are configured to facilitate use in combination with means for containing spillage or leakage of drum contents when such contents are of a hazardous nature.

BACKGROUND OF THE INVENTION

During storage of industrial drums, environmental and safety concerns and regulations warrant the use of means for stacking the drums in a secure and safe manner. Additionally such regulations may require the use of means for retaining drum contents when spilled in the course of dispensing or released due to drum leakage. Such containment is especially important when contents of the drums are hazardous to the environment or to personnel in the workplace.

Means for retaining spilled or leaked material are described in U.S. Pat. No. 5,307,931, U.S. Pat. No. 5,375,537, and U.S. Pat. No. 5,392,911, all of which are assigned to the assignee of the present invention. Such means comprise a rectangular retaining tray having a top grate member for supporting the drums. Certain embodiments of the present invention can be used in combination with such retaining means.

Components of the present invention are of a modular nature and can be combined in many configurations to provide for storage of one or a plurality of drums. Use of the system can be independent or in combination with the retaining means, depending on the contents of the drums.

SUMMARY OF THE INVENTION

Components of the modular industrial drum storage system of the invention are preferably roto-molded of a non-corrosive material such as polyethylene. Such system comprises four modular components: a stand for supporting a drum, a single drum stacker for supporting a single top drum vertically above a single bottom drum, a two-drum stacker for supporting two top drums vertically above two side-by-side bottom drums, and a container tray for use in supporting a container during dispensing of material from a drum to capture and direct any spilled material to a spill retaining means. Such modular units can be combined in a plurality of configurations to achieve storage requirements. The single-drum stacker incorporates means for bearing on a drum stand so as to safely stack the drums. The two-drum stacker bears on two side-by-side bottom drums thus providing stability for safe stacking. All of the components feature a channel for passage of spilled or leaked material to the retaining means. Ribbed portions of the components are provided for rigidity and strength for the components. The container tray can be engaged with the single drum or two-drum stacker and is movable for locating at other stackers even when drums are in place. Such feature enables relocation and use of a single container tray for dispensing material from a plurality of drums.

Other specific features and contributions of the invention are described in more detail below with reference being made to the accompanying drawings.

DETAILED DESCRIPTION OF THE INVENTION

The four components of the modular industrial drum storage system of the invention depicted in FIGS. 1–4 are molded, preferably by the roto-molded method, of a non-corrosive plastic material preferably polyethylene.

An industrial drum, as referred to in relation to the invention, comprises a container having a cylindrical side wall intermediate two opposed ends and a central longitudinal axis. Storage of drums with use of the system is with the central axis of the drum in a substantially horizontal orientation. Dispensing means are typically located in one of the opposed ends. The drums are usually of metal, plastic or fiberglass construction and may have a capacity of 55 gallons of liquid. Such drums are standardized in size and features and are well known in manufacturing industries. Although certain dimensions of components of the invention are selected for use with a 55 gallon drum, use with other size drums is not ruled out. Drum contents can include ingredients for manufacture of comestibles, soaps and detergents, solvents, lubricants, etc.

The invention is primarily concerned with use of components of the system in combination with spilled-hazardous material retaining trays having a generally horizontally oriented support surface with a plurality of apertures to enable spilled or leaking contents of drums to drain into the tray thus preventing contamination of the environment. However, use with industrial drums containing material of a non-hazardous nature is available with all of the components of the invention.

Figure 1:
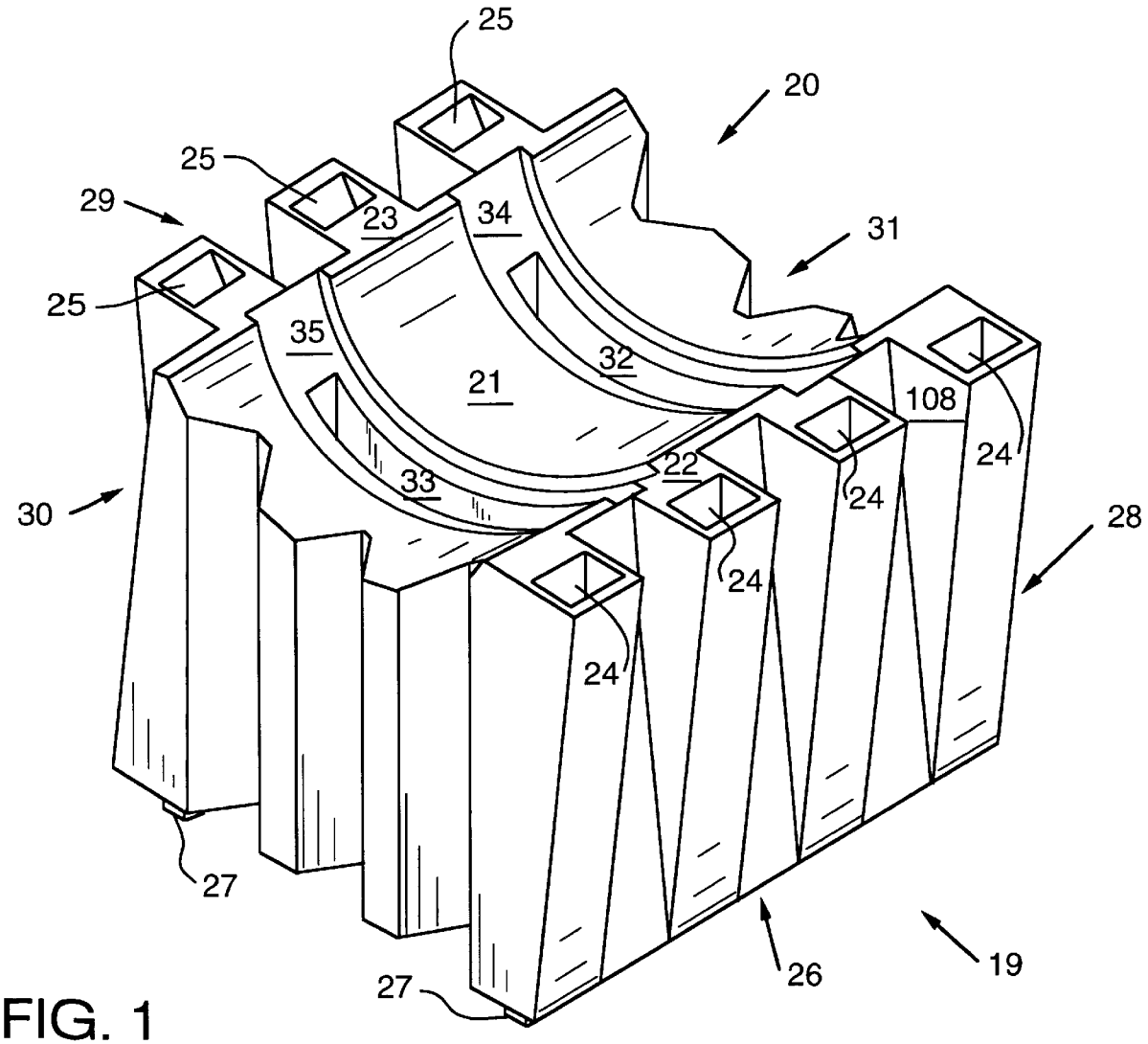
FIG. 1 is a perspective view of a stand of the invention for supporting a drum and engaging a support surface on a retaining tray.

FIG. 1 depicts stand 19 of the invention for supporting a drum having its central axis substantially horizontally oriented. The stand comprises a top 20 having a central concave portion 21 flanked by lateral portions 22 and 23. The concave portion provides a surface for seating of the cylindrical side wall of a supported drum. In a preferred embodiment the concave portion is of a semi-cylindrical shape and matches the cylindrical side wall of the supported drum. Lateral portions 22 and 23 have a plurality of recesses such as 24 and 25 for engaging a single drum stacker component described below. Such recesses are generally arranged in a line which is substantially parallel to the central axis of a drum when supported on the stand.

Opposing the top is a generally planer bottom 26 which, when used in combination with a hazardous-material retainer such as a retaining tray having a support surface with a plurality of apertures, bears on the support surface. Such retaining devices are described in U.S. Pat. No. 5,307,931, U.S. Pat. No. 5,375,537 and U.S. Pat. No. 5,392,911 which are incorporated by reference herein. In a preferred embodiment a plurality of protrusions such as 27 protrude from bottom 26 and engage in such apertures. Such engagement serves to maintain proper positioning of the stand and thus the supported drum, in relation to the hazardous-material retainer, such that the support surface, having apertures for draining to the retaining tray, is vertically beneath the entire drum so as to capture any spilled or leaked contents of the drum.

Extending from top 20 and terminating at bottom 26 are ribbed opposed sides 28 and 29, and ribbed opposed ends 30 and 31. Such ribbing provides rigidity and strength to the stand.

Extending from the central concave portion 21 of top 20 and terminating at bottom 26 are drainage channels 32 and 33. Such channels enable spilled or leaked material to drain to the support surface for access to the hazardous-material retaining tray through the apertures. Such channels, 32 and 33, additionally add vertical strength to the stand. The preferred embodiment depicted in FIG. 1 features two such channels, other embodiments can have solely one, or more than the two, described in the preferred embodiment.

Recessed valley portions 34 and 35 surrounding the top ends of channels 32 and 33 assist in directing spilled or leaked material toward channels 32 and 33 and also provide a space. for locating circular reinforcing ribs commonly found on the cylindrical side wall of an industrial drum. Such recessed valley portions, 34 and 35, enable more solid seating of the cylindrical side wall of the supported drum in the central concave portion of the top.

Figure 2:
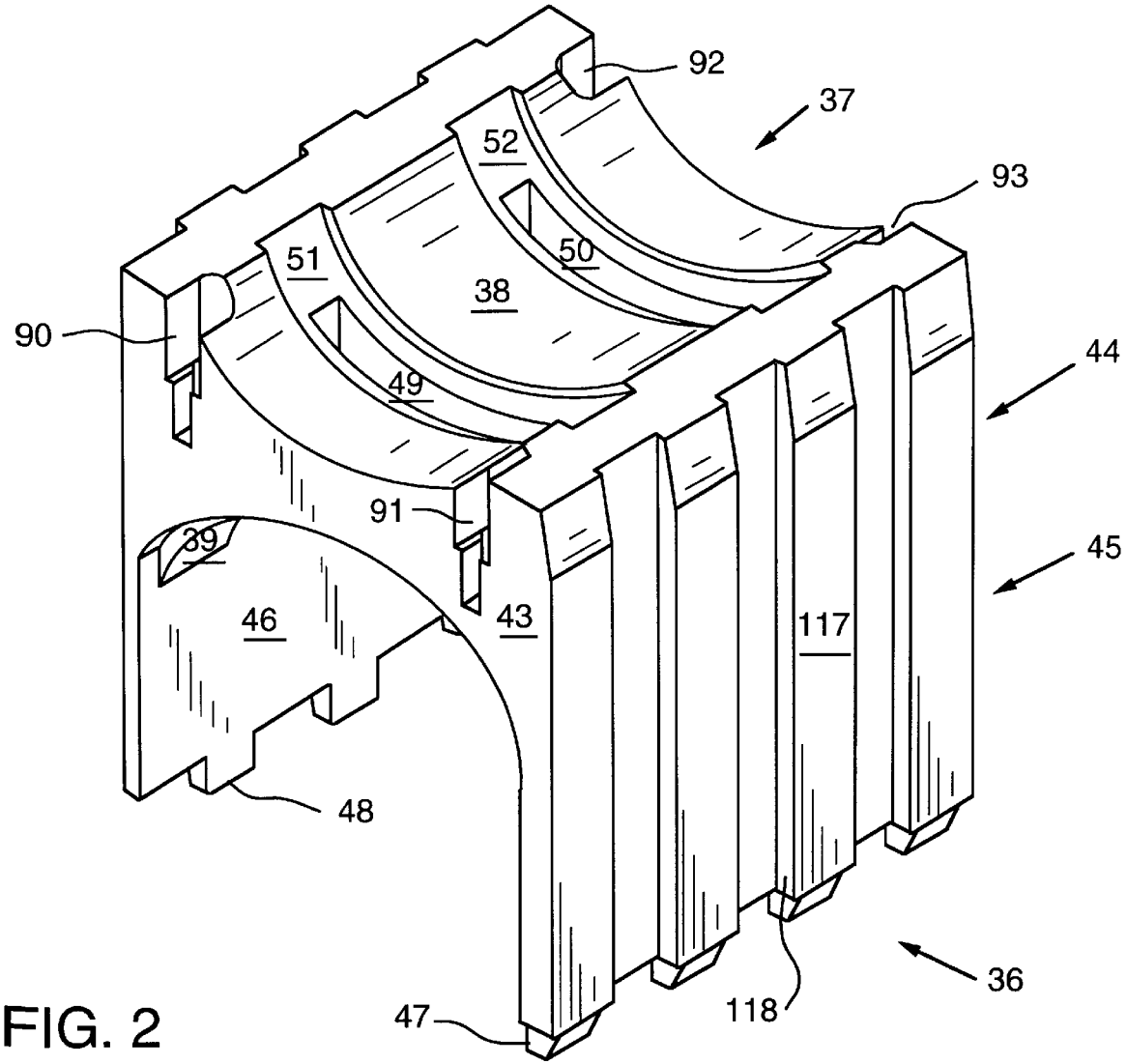
FIG. 2 is a perspective view of a single drum stacker of the invention for supporting a single top drum vertically above a single bottom drum.

FIG. 2 depicts single-drum stacker 36 of the invention for supporting a top drum. Such drum has its central axis substantially horizontally oriented and located vertically above a bottom drum supported on a stand component of the invention. The single-drum stacker comprises a top 37 having a central concave portion 38 for supporting the cylindrical side wall of the top drum. In a preferred embodiment the concave surface is semi-cylindrical in shape and matches the cylindrical side wall of the supported top drum.

Figure 6:
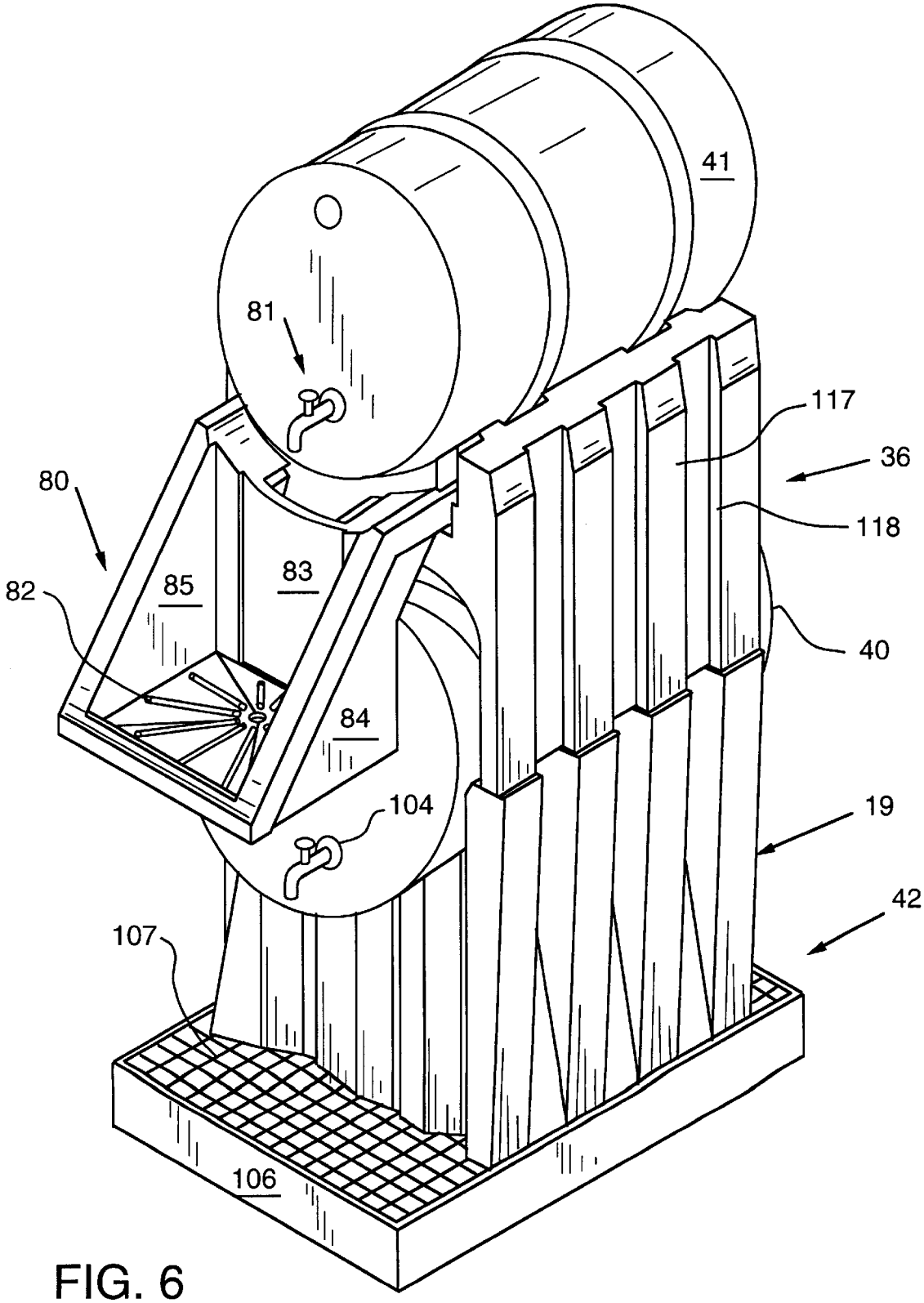
FIG. 6 is a perspective view of components of the invention for describing a configuration for stacking a single drum vertically above a single bottom drum, in combination with a hazardous-material retaining means.

Opposing top 37 is a concave bottom 39 which straddles a bottom drum supported on a stand component of the invention. Such stacking configuration is depicted in FIG. 6, wherein bottom drum 40 is supported by stand 19 and top drum 41 is supported by single-drum stacker 36. Stand 19 is supported by hazardous-material retainer means 42.

Referring back to FIG. 2, in the preferred embodiment, bottom 39 is semi-cylindrical in shape with a radius of curvature greater than that of the bottom drum such that contact is not made with the bottom drum.

Extending from top 37 and terminating at bottom 39 are end 43 and a similar opposed end 44.

Extending from top 37 are ribbed side 45 and a similar opposed ribbed side 46. Such sides, like the bottom, straddle the bottom drum and their inner surfaces (as seen on side 46) are spaced so as not to contact the cylindrical side wall of the bottom drum. Such sides terminate in a base for supporting engagement with the stand. A plurality of protrusions, such as 47 and 48 are arranged for seating in recesses of stand 19, such as recesses 24 and 25 respectively of FIG. 1.

When used in combination with the stand, stand 19 supports a bottom drum and single-drum stacker 36 seats with stand 19, straddles the bottom drum, and supports a top drum. The clearance between the cylindrical side walls of the bottom drum and the sides and bottom of the single-drum stacker facilitates removal of the bottom drum when its use or replacement is required. During such removal or replacement of the bottom drum the top drum can remain in place.

Extending from central concave portion 38 of top 37 of single drum stacker 36 and terminating at bottom 39 are drainage channels 49 and 50. Such channels enable spilled or leaked material to drain to the hazardous-material retaining tray. Such channels, 49 and 50, also provide additional vertical strength to stacker 36.

Recessed valley portions 51 and 52, surrounding the top ends of channels 49 and 50, assist in directing spilled or leaked material to channels 49 and 50 and provide a space for reinforcing ribs located on the cylindrical side wall of the drum. Such space enables more solid seating of the cylindrical side wall of the top drum on stacker 36.

When used in combination with stand component 19 and hazardous-material retainer 42, and with the drums stacked in vertical alignment, vertically above the support surface of the hazardous-material retainer, as depicted in FIG. 6, any spilled or leaked material from top drum 41 or bottom drum 40 drains to the hazardous-material retainer 42 thus preventing contamination of the environment.

Figure 3:
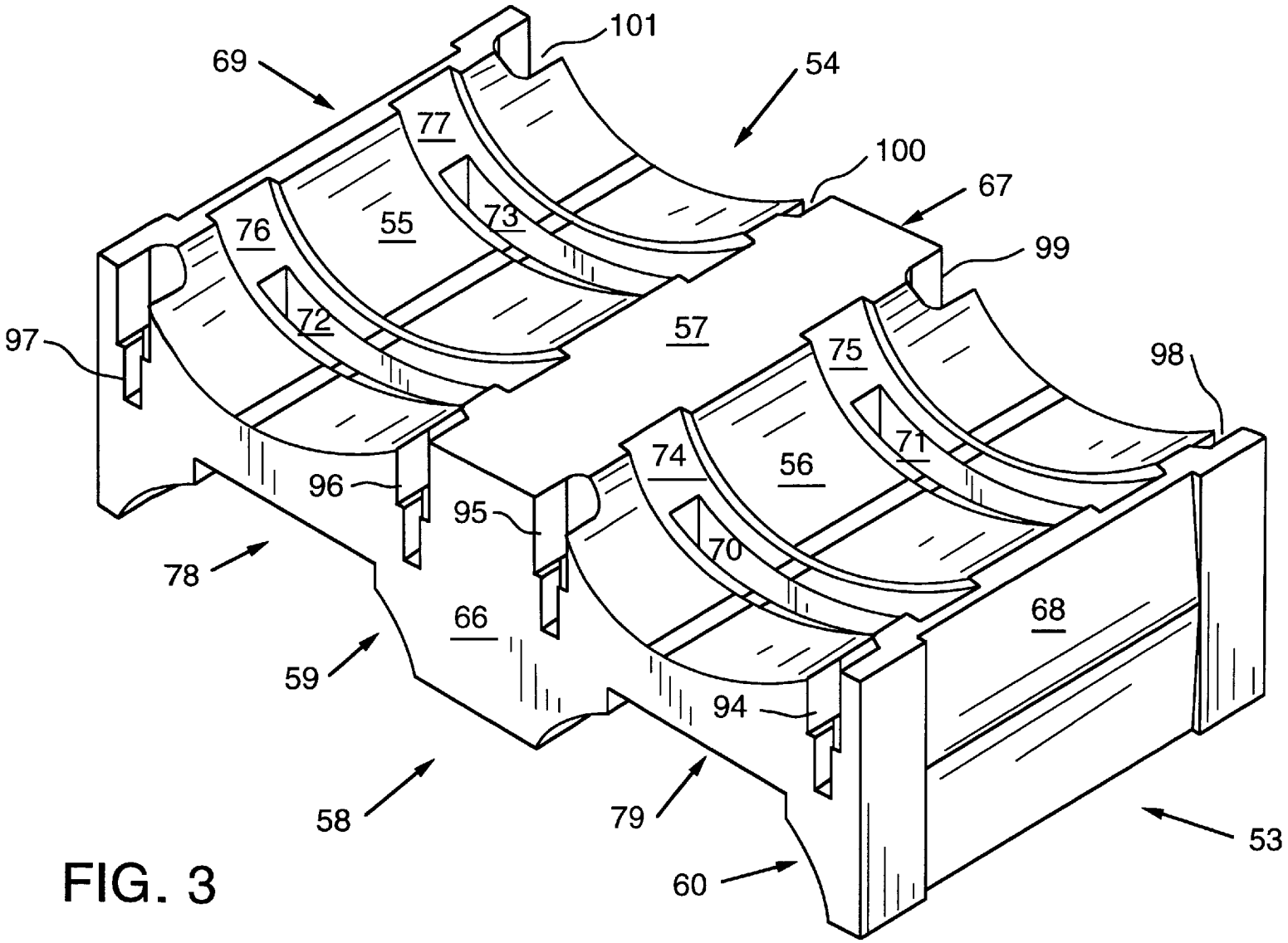
FIG. 3 is a perspective view of a two-drum stacker of the invention for supporting two top drums vertically above two side-by-side bottom drums.

FIG. 3 depicts a two-drum stacker 53 of the invention for supporting two top drums vertically above two side-by-side bottom drums. All of the drums are oriented such that their central axes are substantially horizontal. Two-drum stacker 53 comprises a top 54 having two side by side concave portions 55 and 56. for supporting the two top drums. The concave portions, 55 and 56, are separated by central portion 57 which provides proper lateral spacing for the drums. In a preferred embodiment the concave portions, 55 and 56, have a semi-cylindrical shape to match the cylindrical side wall of each top drum.

Figure 7:
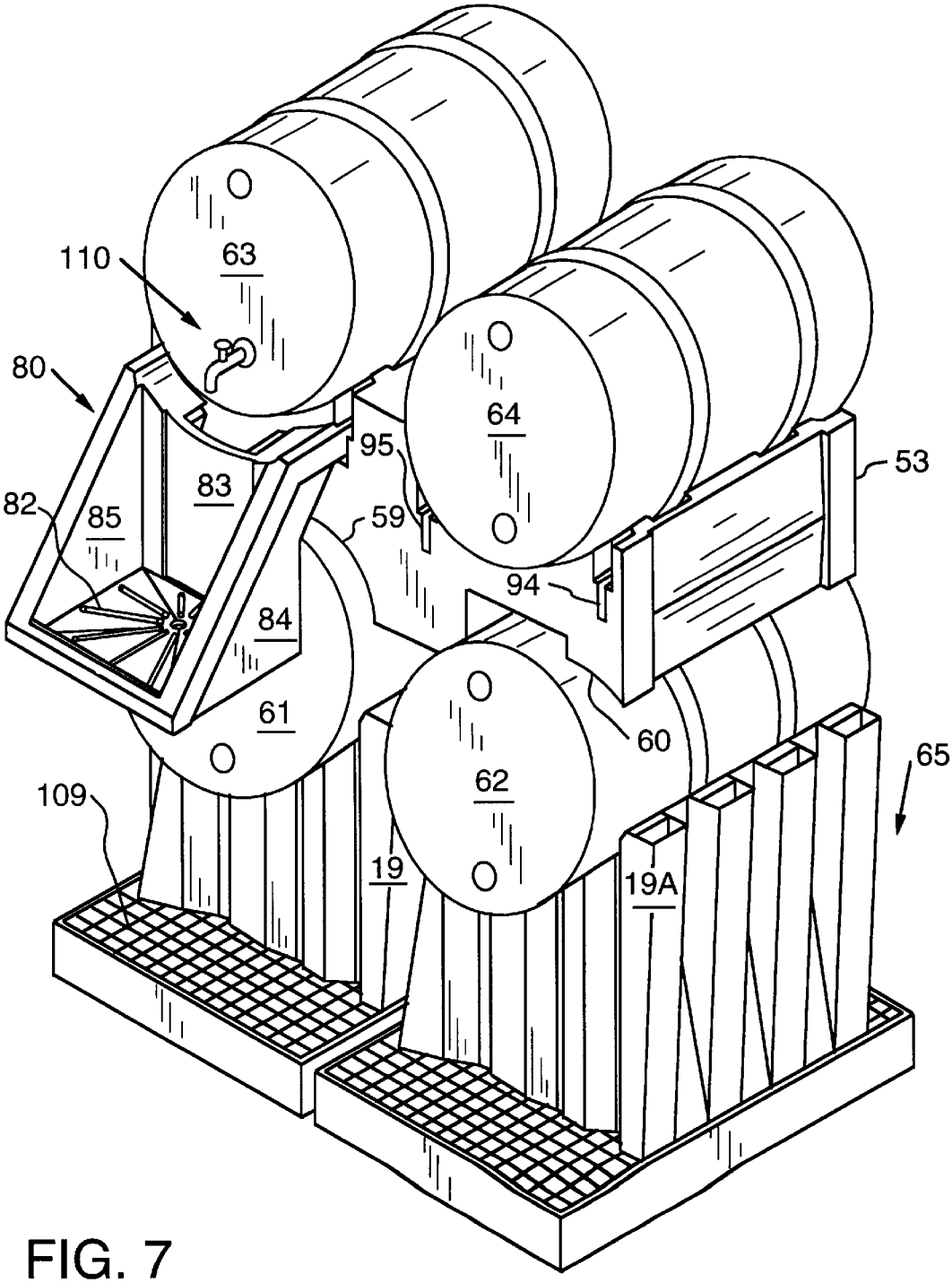
FIG. 7 is a perspective view of components of the invention for describing a configuration for stacking two drums, one each vertically above two side-by-side bottom drums, with use of one two-drum stacker, in combination with a hazardous-material retaining means.

Opposing top 54 is a bottom 58 having two generally concave portions 59 and 60 for bearing on two bottom drums. Such concave portions 59 and 60 are spaced so as to provide the proper lateral spacing to obtain vertical alignment of two top drums with two bottom drums. In a preferred embodiment, concave portions 59 and 60 have a semi-cylindrical shape and match the shape of the cylindrical side walls of the bottom drums. Such stacking configuration is depicted in FIG. 7 wherein bottom drums 61 and 62 are supported by stands 19 and 19A, top drums 63 and 64 are supported by two-drum stacker 53, and all of the components and drums are supported by hazardous-material retainer 65. Referring back to FIG. 3, extending from top 54 and terminating at bottom 58 are end 66 and an opposing similar end 67 and side 68 and an opposing similar side 69.

Extending from the two concave portions 55 and 56 of top 54 and terminating at bottom 58 are drainage channels 70, 71, 72 and 73. Such channels enable drainage of spilled or leaked material toward the hazardous-material retainer when the bottom drums are on stands supported by the hazardous-material retainer.

Recessed valley portions 74, 75, 76 and 77 surrounding the top ends of drainage channels 70, 71, 72 and 73 assist in directing spilled or leaked material to the channels as well as providing space for reinforcing ribs in the cylindrical side walls of the two top drums. A similar recessed valley portion can be located in the concave portions of the bottom to provide space for ribs of the two bottom drums and enable more solid seating of the stacker on the two bottom drums.

When such a two-drum stacker 53 is used in combination with stands 19 (FIG. 1), as depicted in FIG. 7, two stands 19 and 19A are used in side-by-side arrangement with stand spacing determined by the location of the concave portions of two-drum stacker 53.

Open channels 78 and 79 in two-drum stacker 53 enable entry of forklift tines for relocating the top drums while still seated on stacker 53.

Figure 4:
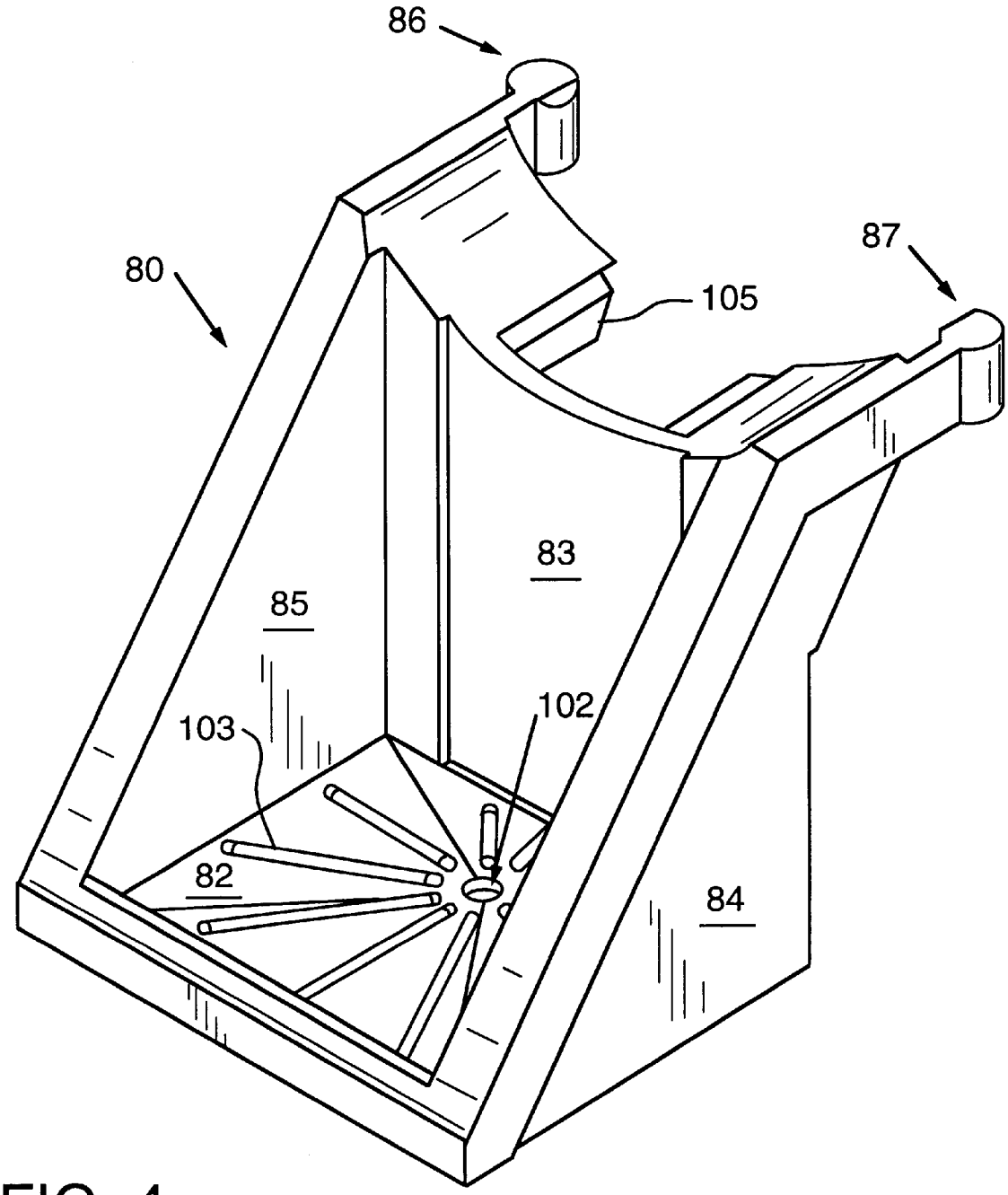
FIG. 4 is a perspective view of a container tray of the invention for supporting a receiving container while dispensing material from a drum supported by a stacker of the invention.
Figure 5:
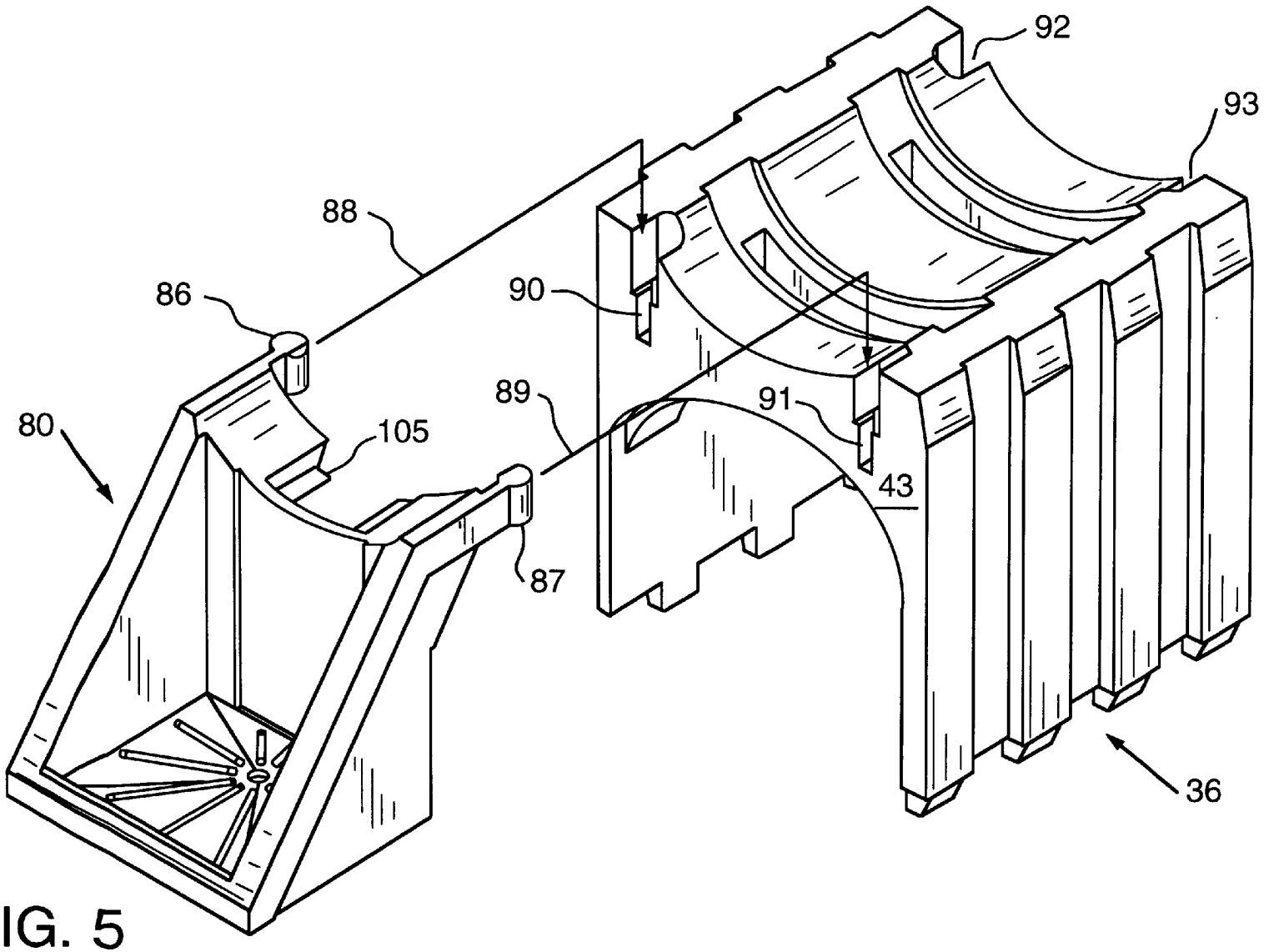
FIG. 5 is a perspective view for describing engagement of the container tray of FIG. 4 with the stacker of the invention.

FIG. 4 depicts a container tray 80 of the invention for supporting a container to receive material being dispensed from a drum. A dispensing means such as a valve is most often located in a threaded opening in one end of the drum. FIG. 6 depicts valve 81 in one end of top drum 41. During dispensing of material from drum 41, a container can be supported by tray 80 so as to facilitate the procedure. Referring to FIG. 4, tray 80 comprises horizontally oriented shelf 82 having vertically oriented back 83 extending from a back edge of the shelf. Side portions 84 and 85 extend from side edges of shelf 82 and terminate at back 83 to provide rigidity between shelf 82 and back 83 so as to maintain shelf 82 in a horizontal orientation when subjected to the weight of the container and its contents. Such a container tray is designed to engage single-drum stacker 36 (FIG. 2) or two-drum stacker 53 (FIG. 3) of the invention through hangers 86 and 87 which protrude from the tray. Referring to FIG. 5, solid lines with arrows 88 and 89 indicate the manner in which hangers 86 and 87 are inserted and slid downward to engage in slots 90 and 91 in single-drum stacker 36. Such slots are restricted in width near stacker end 43 to prevent disengagement of tray 80 after sliding the hangers, 86 and 87, into slots 90 and 91. Additional slots 92 and 93 are located on the other end of stacker 36 so as to simplify use of the stacker by eliminating a need, when placing the stacker, to determine which end of the stacker can accommodate the container tray. Placement of slots at both ends of the stacker also facilitates dispensing at either end of the drum if dispensing means are provided in both ends of the supported drum.

Such slots are also provided in two-drum stacker 53 as indicated in FIG. 3 at reference numerals 94–101. Use of container tray 80 in such a two-drum stacker 53 is similar to that of the one-drum stacker 36 as described immediately above.

Container tray 80 (FIG. 4) is provided with a drainage aperture 102 to remove spilled material from shelf 82 during dispensing. Such aperture, 102,is located toward the back of shelf 82 so as to direct the spilled material downward toward the hazardous-material retainer. As depicted in FIGS. 6–10 such hazardous-material retainers extend beyond the stand components such that they are vertically below aperture 102 of the shelf. Ribs such as 103 in shelf 82 (FIG. 4) maintain clearance between the container and the shelf to facilitate drainage of spilled material and direct spillage to aperture 102. Dispensing of material from a lower drum such as from valve 104 of drum 40 in FIG. 6 can be accomplished by placement of a container on the support surface of retainer 42 and a container tray such as 80 is not required. During such dispensing, spilled material is drained to the hazardous-material retainer through the apertures of the support surface.

Referring to FIGS. 6–10, the back of container tray 80 bears against an end of an associated bottom drum. For example, in FIG. 6 container tray 80, being used for dispensing from top drum 41, bears on the end of bottom drum 40. Such bearing helps in maintaining the shelf of the tray in a horizontal orientation. When a bottom drum is not present, a stop pad, 105, best viewed in FIG. 4, maintains such orientation.

Figure 9:
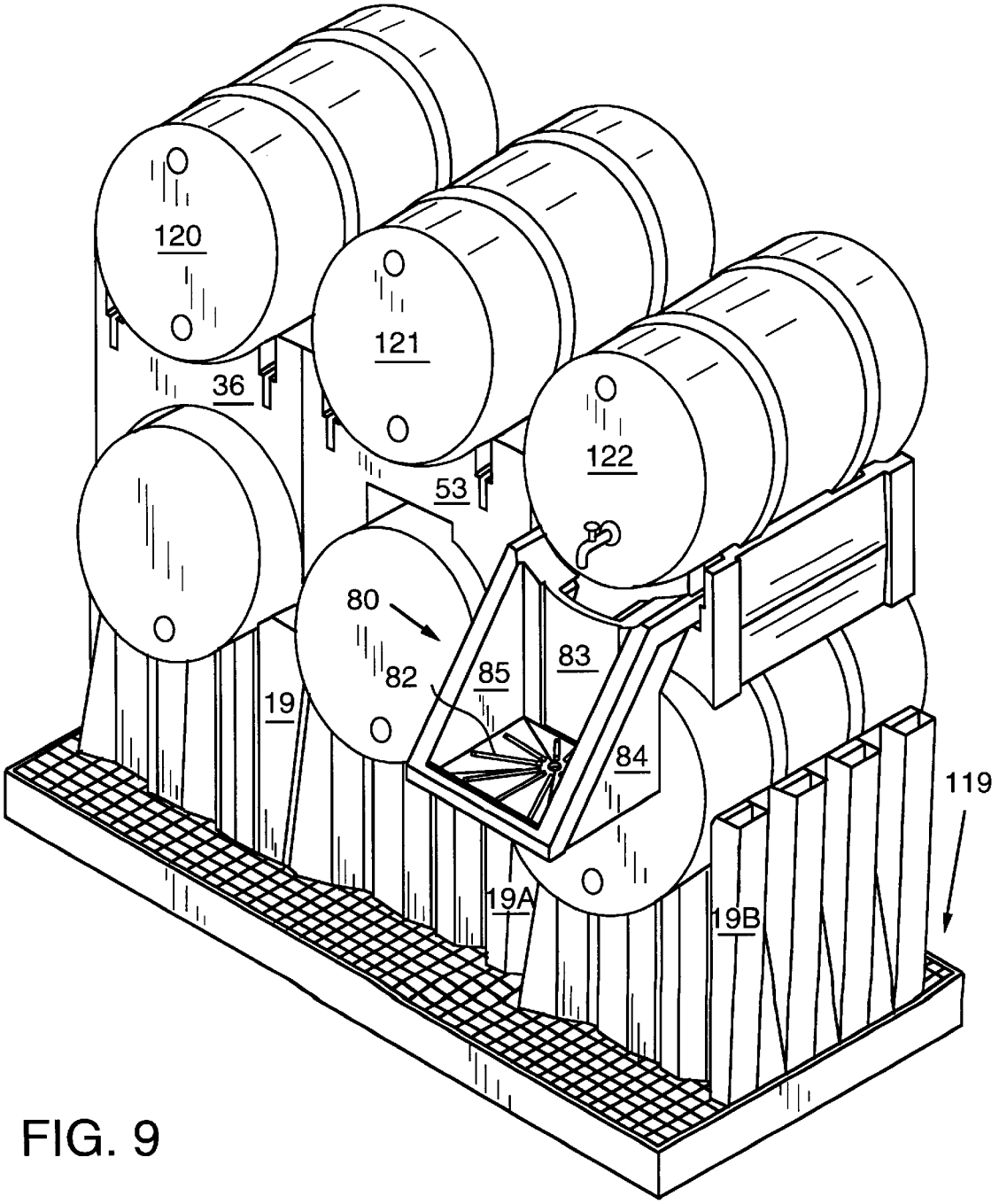
FIG. 9 is a perspective view of components of the invention for describing a configuration for stacking three drums vertically above three side-by-side bottom drums, in combination with a hazardous-material retaining means.
Figure 10:
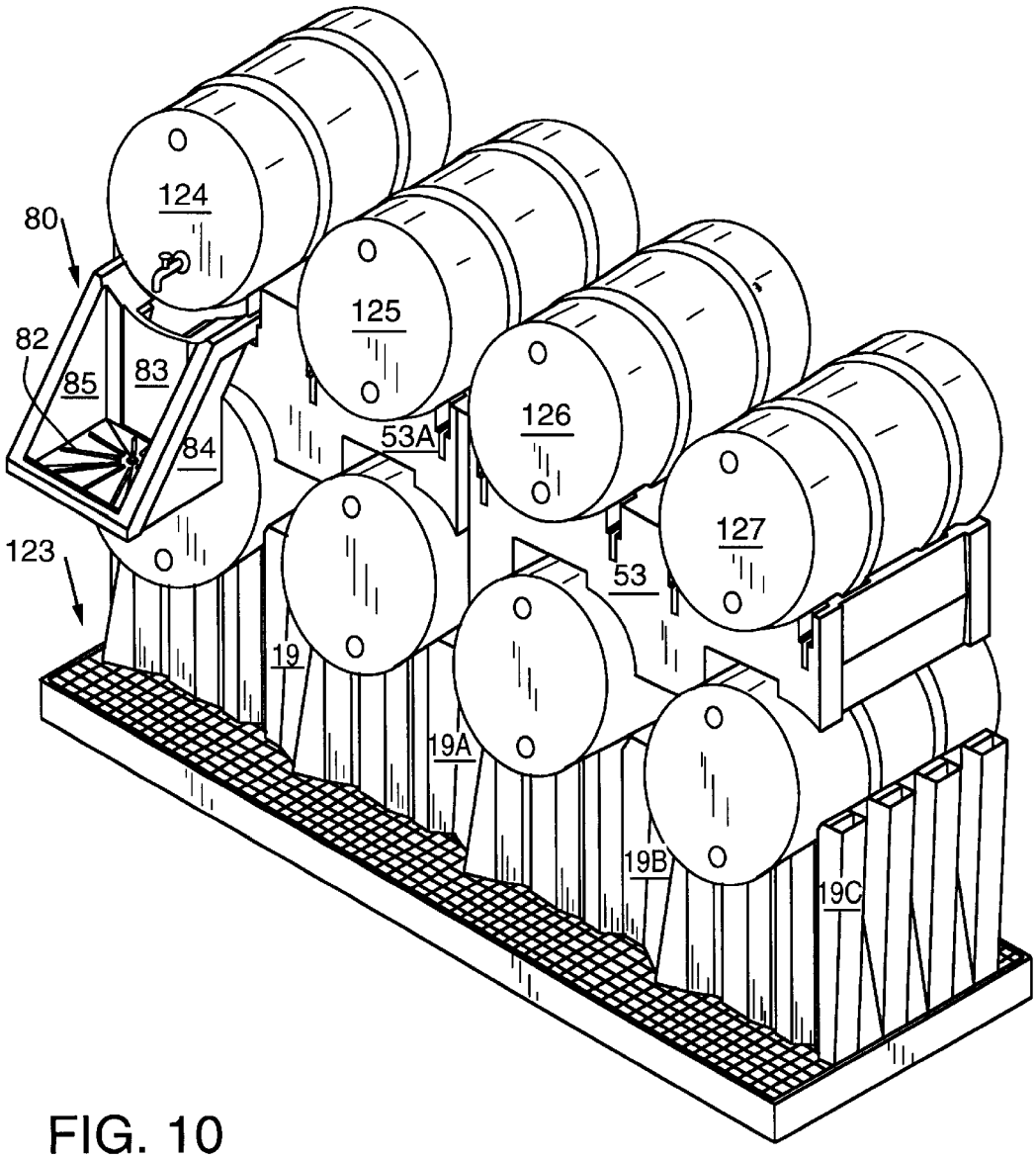
FIG. 10 is a perspective view of components of the invention for describing a configuration for stacking four drums vertically above four side-by-side bottom drums, in combination with a hazardous-material retaining means.

As mentioned above, the modular industrial drum storage system comprises four basic units (depicted in FIGS. 1–4) which can be configured in many ways to provide for the industrial drum storage requirements. FIGS. 6–10 depict five possible configurations. Many other configurations are possible. All of the configurations are depicted in combination with hazardous-material retainer which is preferred when hazardous materials are being stored and dispensed. Referring to FIG. 6, the hazardous-material retainer includes retaining tray 106 and support surface 107 which contains a plurality of apertures to enable drainage into the tray. Hazardous-material retainers of various sizes can be used with the differing configurations, as depicted in FIGS. 6–10. In FIG. 7 two bottom drums 61 and 62 are stored side-by-side on two stands, 19 and 19A supported on a "two-wide" hazardous-material retaining tray 65. FIGS. 7, 9 and 10 depict a "two-wide", "three-wide", and "four-wide" hazardous-material retainer respectively. As depicted in such figures support surface components having a size such as that of 107 of FIG. 6 can be used in various combinations with any of the trays. Such hazardous-material retaining trays and support surfaces are known in the art and are described in detail in the patents incorporated herein by reference above.

In FIG. 7 two stands, 19 and 19A are positioned side-by-side to support bottom drums 61 and 62. To enable proper spacing of the stands, the ribs of the sides of stands 19 and 19A are arranged to mesh and enable closer placement of the stands. Such rib arrangement is more clearly depicted in FIG. 1 wherein side 28 presents 4 spaced ribs and side 29 presents 3 spaced ribs. When two similar stands are placed side-by-side the 3 ribs of side 29 mesh in spaces between the 4 ribs of side 28. In the preferred embodiment (depicted in FIG. 1) ribs 28 and 29 are tapered in thickness, from the top to the bottom, as measured in a horizontal direction perpendicular to the central axis of a supported drum, such taper is evident by the triangular shaped edge 108. Such meshing of ribs provides for proper alignment of the stands and improves their stability.

Referring back to FIG. 7, two-drum stacker 53 is positioned to bear on bottom drums 61 and 62. The bottom concave portions 59 and 60 of two-drum stacker 53 bear on the cylindrical side walls of the drums. Two drums, 63 and 64, are supported by stacker 53 with their cylindrical side walls seating in the concave portions of top 54. Storage with use of two-drum stacker 53 adds stability to the stacked drums as stacker 53 spans the two vertical stacks (drums 61 and 63, drums 62 and 64) and eliminates any threat of the stacks leaning or falling towards one of the sides. The component configuration of FIG. 7 is supported on a hazardous-material retainer with stands 19 and 19A bearing on support surface 109. Any spilled or leaked material can drain through apertures in the support surface into retaining tray 65. Such hazardous-material retainer features a tray having a width to accommodate two side-by-side stands. Container tray 80 is shown positioned for use to dispense material from valve 110 of drum 63. Slots 94 and 95 are available for a second container tray or movement of tray 80 to such position. The slots are shaped, as best seen in FIG. 5, to enable attachment or removal of the container tray without removal of the drum(s) from the stacker.

Figure 8:
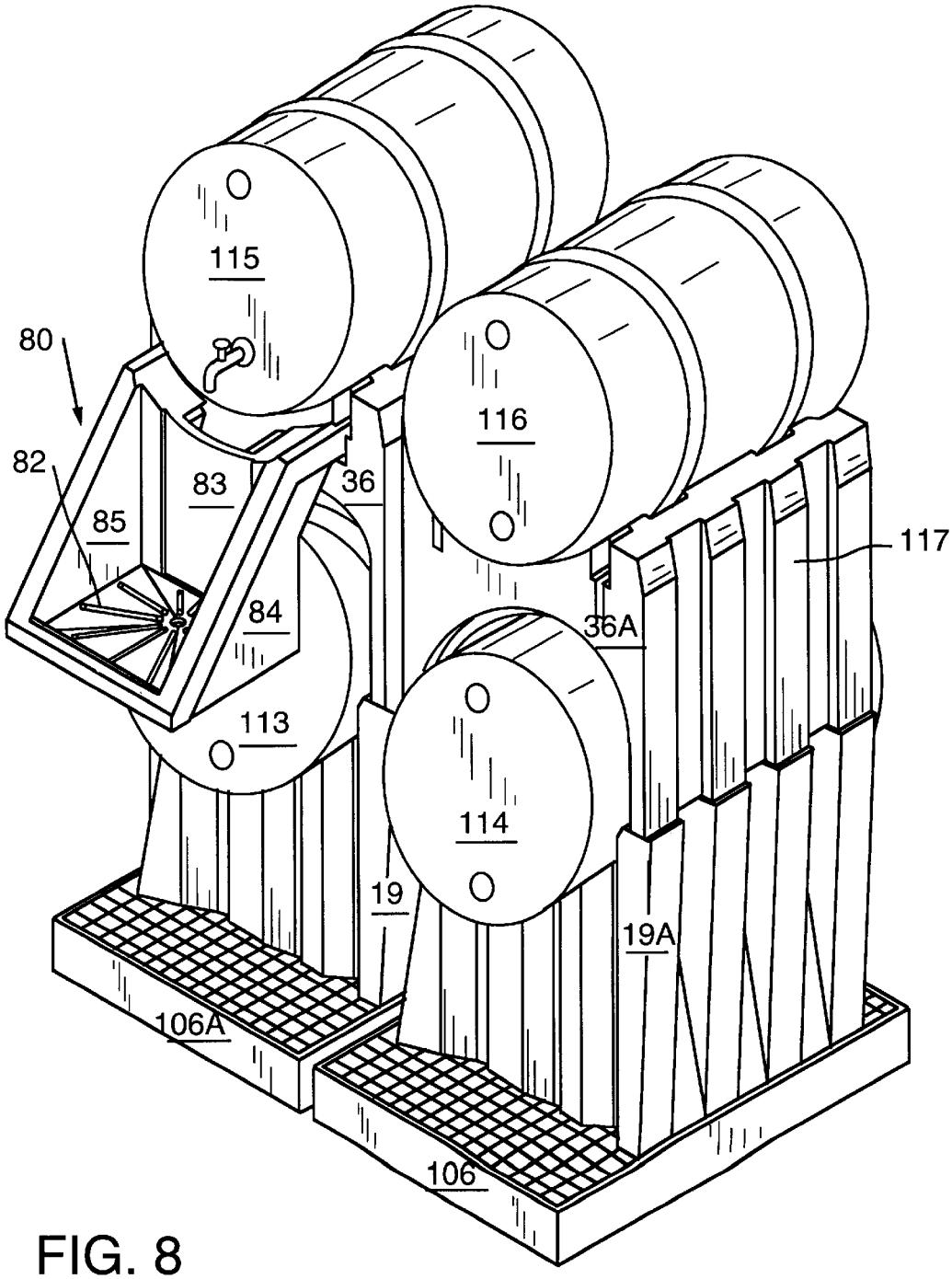
FIG. 8 is a perspective view of components of the invention for describing a configuration for stacking two drums, one each vertically above two side-by-side bottom drums, with use of two single drum stackers, in combination with a hazardous-material retaining means.

FIG. 8 depicts a second configuration for storing two top drums vertically above two side-by-side bottom drums with all of the drums oriented with their central axis substantially horizontal. Bottom drums 113 and 114 are supported on stands 19 and 19A respectively in the same manner as described with reference to.FIG. 7. Top drums 115 and 116 however, in contrast to FIG. 7, are each supported by a single-drum stacker, 36 and 36A. Single-drum stackers 36 and 36A are positioned for support on stands 19 and 19A respectively. Protrusions such as 47 and 48 on single-drum stackers 36 and 36A seat in recesses 24 and 25 of stands 19 and 19A to provide proper alignment and stability. Like the stands 19 and 19A, such single-drum stackers 36 and 36A also present ribs in their sides which mesh when in close side-by-side relationship. Arrangement of the ribs, such as 117, is best seen in FIG. 2 wherein side 45 presents 4 spaced ribs and side 46 presents 3 spaced ribs. In the preferred embodiment depicted in FIG. 2 such ribs 117 are of a generally uniform thickness as exemplified by the ribs having rectangular shaped edges such as 118. Such ribs assist in providing proper alignment of stackers 36 and add to the stability of the assembled components. As described above, single-drum stackers 36 are supported by their associated stands 19 and do not bear on the bottom drums. Such feature enables removal or insertion of a bottom drum without removal of a top drum of single-drum stacker 36. Such feature is not available with use of the configuration of FIG. 7 as two-drum stacker 53 bears on the bottom drums.

Container tray 80 (FIG. 8) is depicted positioned for use in dispensing material from drum 115. As with two-drum stacker 53, it can be removed or replaced without removal of any top drums In contrast to the configuration of FIG. 7, hazardous-material retaining means 106 and 106A, which only span a single stack 19 and 19A, are used. The configuration of FIG. 8 with such "one-wide" hazardous-material retainer and two single-drum stackers 36 and 36A enables any desired spacing between the two stacks.

FIG. 9 depicts a configuration wherein six drums are stored. Three stands, 19, 19A, and 19B, are disposed side-by-side on hazardous-material retainer 119 which spans all three stands. A combination of a two-drum stacker 53 and a single-drum stacker 36 is used to support three top drums 120, 121 and 122. Container tray 80 is shown for use with drum 122. Any spillage while dispensing material is directed through the aperture in the shelf of the tray into hazardous-material retainer 119.

FIG. 10 depicts a configuration wherein eight drums are stored. Four stands, 19, 19A, 19B, and 19C are disposed side-by-side on hazardous-material retainer 123 which spans all four stands. A combination of two two-drum stackers 53 and 53A is used to support four top drums 124, 125, 126 and 127. Container tray 80 is positioned for use in dispensing material from drum 124. Any spillage during dispensing is directed through the aperture in the shelf of the container tray to hazardous-material retainer 123.

As apparent from the configurations depicted in FIGS. 6–10 a multitude of configurations are possible. The two configurations depicted in FIGS. 6 and 7 form "basic" configurations of the modular components which can be combined to form any configuration required. The configurations of FIGS. 8–10 are arrived at by different combinations of the two "basic" configurations. Using the modular components of the invention in combination with known hazardous-material retaining means, hazardous material can be stored and dispensed in a manner complying with safety and environmental regulations.

What is claimed is:

1. A stand for supporting an industrial drum having a cylindrical side wall intermediate two opposed ends and disposed with its central axis substantially horizontally oriented, said stand arranged to engage with a spilled-hazardous-material retaining tray having a support surface with a plurality of apertures to enable drainage into the tray, said engagement to position the drum such that the support surface is vertically beneath the drum, comprising:

a top, having a concave central portion for seating of the cylindrical side wall of a supported drum, and two lateral portions flanking the central portion, each having a plurality of recesses, a bottom, arranged for engagement with the support surface, having a plurality of protrusions arranged for seating in the support surface apertures, ribbed opposed ends extending downwardly from said top and terminating at said bottom, ribbed opposed sides extending downwardly from said top and terminating at said bottom, and at least one drainage channel extending downwardly from said top concave portion and terminating at said bottom.

2. A stand for supporting an industrial drum according to claim 1, wherein said stand is formed by roto-molding polyethylene.

3. A stand for supporting an industrial drum according to claim 1, wherein the supported drum has at least one re-enforcing rib encircling its cylindrical side wall, further comprising a recessed valley in the concave portion of the top, located so as to surround the top of each drainage channel and to coincide with the location of each re-enforcing rib of a supported drum, so as to direct material to the drainage channel and enable solid seating of the cylindrical side wall of the supported drum on the concave portion of the top.

4. A stand for supporting an industrial drum according to claim 1, wherein the concave portion of the top is shaped to match the cylindrical side wall of a supported 55 gallon drum.

5. A stand for supporting an industrial drum according to claim 1, wherein the ribbed opposed sides extending downwardly from the top and terminating at the bottom are arranged such that when two said stands are positioned side-by-side in contact with each other the ribs of one of the stands mesh between the ribs of the remaining stand.

6. A stand for supporting an industrial drum according to claim 5, wherein said ribs vary in thickness, as measured from the top to the bottom in a horizontal direction perpendicular to the central axis of a supported drum.

7. A stand for supporting an industrial drum according to claim 1, wherein the plurality of recesses in the two lateral portions of the top are positioned along a line in a direction substantially parallel to the central axis of the supported drum.

8. A single-drum stacker for supporting an industrial drum disposed vertically above an industrial drum supported on a stand, each said drum having a cylindrical side wall intermediate two opposed ends and disposed with its central axis substantially horizontally oriented, said stand having a top with a plurality of recesses, comprising:

a top having a concave central portion for seating of the cylindrical side wall of a supported top drum, a concave bottom for straddling the cylindrical side wall of a bottom drum, opposed ends extending downwardly from said top and terminating at said bottom, ribbed opposed sides extending downwardly from said top, extending past the concave bottom and ending in a lower edge a plurality of protrusions extending from said lower edge and arranged for seating in the recesses of the stand, and at least one drainage channel extending downwardly from said top concave portion and terminating at said bottom.

9. A single-drum stacker according to claim 8, wherein said stacker is formed by roto-molding polyethylene.

10. A single-drum stacker according to claim 8, wherein the supported top drum has at least one re-enforcing rib encircling its cylindrical side wall, further comprising a recessed valley in the concave portion of the top, located so as to surround the top of each drainage channel and to coincide with the location of each re-enforcing rib of a supported drum, so as to direct material to the drainage channel and enable solid seating of the cylindrical side wall of the supported drum on the concave portion of the top.

11. A single-drum stacker according to claim 8, wherein the concave portion of the top is shaped to match the cylindrical side wall of a supported 55 gallon drum and the bottom straddles a 55 gallon drum.

12. A single-drum stacker according to claim 8, wherein the ribbed opposed sides extending downwardly from the top and terminating at the bottom are arranged such that when two side stackers are positioned side-by-side in contact with each other the ribs of one of the stackers mesh between the ribs of the remaining stacker.

13. A single-drum stacker according to claim 8, further comprising means for hanging a container tray for supporting a container positioned for receiving material dispensed from a drum being supported by the stacker.

14. A single-drum stacker according to claim 13, wherein the hanging means enables hanging or removing the container tray while a drum is being supported on the stacker.

15. A two-drum stacker for supporting two industrial drums, one each vertically above two side-by-side industrial drums, each drum having a cylindrical side wall intermediate two opposed ends and disposed with its central axis substantially horizontally oriented, comprising:

a top, having two concave portions for seating of the cylindrical side walls of two supported top drums, a bottom, having two concave portions for seating on the cylindrical side walls of the two bottom drums, opposed sides extending downwardly from said top and terminating at said bottom, opposed ends extending downwardly from said top and terminating at said bottom, and at least one drainage channel extending downwardly from each said top concave portion and terminating at said bottom.

16. A two-drum stacker according to claim 15, wherein said stacker is formed by roto-molding polyethylene.

17. A two-drum stacker according to claim 15, wherein each supported drum has at least one re-enforcing rib encircling its cylindrical side wall, further comprising a recessed valley in each concave portion of the top, located so as to surround the top of each drainage channel and to coincide with the location of each re-enforcing rib of each supported drum, so as to direct material to the drainage channel and enable solid seating of each cylindrical side wall of each supported drum on the concave portion of the top.

18. A two-drum stacker according to claim 15, wherein each concave portion of the top is shaped to match the cylindrical side wall of a supported 55 gallon drum.

19. A two-drum stacker according to claim 15, further comprising means for hanging a container tray for supporting a container positioned for receiving material dispensed from one of the ends of a supported drum.

20. A two-drum stacker according to claim 19, wherein the hanging means enables hanging or removing the container tray while drums are being supported on the stacker.

21. A two-drum stacker according to claim 15, wherein each supporting drum has at least one re-enforcing rib encircling its cylindrical side wall, further comprising a recessed valley in each concave portion of the bottom, located so as to coincide with the location of each re-enforcing rib of each supporting bottom drum so as to enable solid seating of each cylindrical side wall of each supporting drum in the concave portion of the bottom.

22. A two-drum stacker according to claim 21, wherein each supporting drum is a 55 gallon drum and, each concave portion of the bottom is shaped to conform with the cylindrical side wall of each 55 gallon supporting drum.

23. A two-drum stacker according to claim 15, further comprising open-channels for entry of forklift lifting means.

24. A container tray for supporting a container to receive material being dispensed from an industrial drum having a cylindrical side wall intermediate two opposed ends, said drum disposed with its central axis substantially horizontally oriented and its cylindrical side wall seated on a stacker so as to position the drum such that a spilled material retaining tray is vertically beneath the drum, such drum having a dispensing means located in one of its ends, comprising:

a horizontally oriented shelf, for supporting the container being filled, having a front edge and opposed back edge, and two opposed side edges, a vertically oriented back extending upwardly from the back edge, two side portions, one extending from each side edge of the shelf and terminating at the back for rigidly maintaining the shelf at a right angle with the back, two hanging means protruding from the tray for hanging engagement with a drum stacker, and a drainage means in the shelf for draining spilled material from the shelf and directing it to the retaining tray.

25. A container tray according to claim 24, further comprising ribs in the supporting surface of the shelf for providing support to the container being filled and enabling flow of spilled material between the container and the shelf in a direction toward the drainage means.

26. A container tray according to claim 24, further comprising a support member for bearing against the drum stacker for maintaining the horizontal orientation of the shelf.

27. A modular two-drum stacking system for supporting an industrial drum vertically above a second industrial drum, each drum having a cylindrical side wall intermediate two opposed ends and disposed with its axis substantially horizontally oriented, said system arranged to engage with a spilled-material retaining tray having a support surface with a plurality of apertures to enable drainage into the tray, such engagement to position the drums such that the support surface is vertically beneath each drum, comprising:

a. a stand for supporting a bottom drum, comprising
   a top, having a concave central portion for seating of the cylindrical side wall of the supported bottom drum, and two lateral portions flanking the central portion, each having a plurality of recesses,
   a bottom, arranged for engagement with the support surface, having a plurality of protrusions arranged for seating in the support surface apertures,
   ribbed opposed ends extending downwardly from said top and terminating at said bottom,
   ribbed opposed sides extending downwardly from said top and terminating at said bottom, and
   at least one drainage channel extending downwardly from said top concave portion and terminating at said bottom;

b. a single-drum stacker for supporting a top drum, comprising
   a top, having a concave central portion for seating of the cylindrical side wall of the supported top drum,
   a concave bottom for straddling the cylindrical side wall of the bottom drum,
   opposed ends extending downwardly from said top and terminating at said bottom,
   ribbed opposed sides extending downwardly from said top, extending past the concave bottom and ending in a lower edge
   a plurality of protrusions extending from said lower edge and arranged for seating in the recesses of the stand, and
   at least one drainage channel extending downwardly from said top concave portion and terminating at said bottom; and c. a container tray for supporting a container to receive material being dispensed from the top drum, such top drum having a dispensing means located in one of its ends, comprising
   a horizontally oriented shelf for supporting the container being filled, having a front edge and opposed back edge, and two opposed side edges,
   a vertically oriented back portion extending upwardly from the back edge,
   two side portions, one extending from each side edge of the shelf and terminating at the back for rigidly maintaining the shelf at a right angle with the back,
   two hanging means protruding from the tray for hanging engagement with the single drum stacker, and
   a drainage means in the shelf for draining spilled material from the shelf and directing it to the retaining tray.

28. A modular four-drum stacking system for supporting two industrial drums vertically above two side-by-side industrial drums, each drum having a cylindrical side wall intermediate two opposed ends and disposed with its axis substantially horizontally oriented, said system arranged to engage with a spilled-material retaining tray having a support surface with a plurality of apertures to enable drainage into the tray, such engagement to position the drums such that the support surface is vertically beneath each drum, comprising:

a. two stands, in side-by-side arrangement each for supporting a bottom drum, each comprising
   a top, having a concave central portion for seating of the cylindrical side wall of the supported bottom drum,
   a bottom, arranged for engagement with the support surface, having a plurality of protrusions arranged for seating in the support surface apertures,
   ribbed opposed ends extending downwardly from said top and terminating at said bottom,
   ribbed opposed sides extending downwardly from said top and terminating at said bottom,
   at least one drainage channel extending downwardly from said top concave portion and terminating at said bottom;

b. a two-drum stacker for supporting the two top drums, comprising
   a top, having two concave portions for seating of the cylindrical side walls of the two supported top drums,
   a bottom, having two concave portions for seating on the cylindrical side walls of the two bottom drums,
   opposed sides extending downwardly from said top and terminating at said bottom,
   opposed ends extending downwardly from said top and terminating at said bottom, and
   at least one drainage channel extending downwardly from each said top concave portion and terminating at said bottom; and c. at least one container tray, each one for supporting a container for receiving material being dispensed from one of the supported top drum, such drum having a dispensing means located in one of its ends, comprising
   a horizontally oriented shelf, for supporting the container being filled, having a front edge and opposed back edge, and two opposed side edges,
   a vertically oriented back portion extending upwardly from the back edge,
   two side portions, one extending from each side edge of the shelf and terminating at the back for rigidly maintaining the shelf at a right angle with the back,
   two hanging means protruding from the tray for hanging engagement with the two-drum stacker, and
   a drainage means in the shelf for draining spilled material from the shelf and directing it to the retaining tray.

* * * * *